US007063187B1

(12) United States Patent
Lavigne

(10) Patent No.: US 7,063,187 B1
(45) Date of Patent: Jun. 20, 2006

(54) LADDER ATTACHMENT SYSTEM

(76) Inventor: Anthony G. Lavigne, 1210 Snow Hill Rd., East Montpelier, VT (US) 05651

( * ) Notice: Subject to any disclaimer, the term of this patent is extended or adjusted under 35 U.S.C. 154(b) by 77 days.

(21) Appl. No.: 10/850,849

(22) Filed: May 20, 2004

(51) Int. Cl.
*E04G 1/00* (2006.01)
*E04G 3/08* (2006.01)
*E04G 3/00* (2006.01)

(52) U.S. Cl. ..... 182/129; 248/238

(58) Field of Classification Search ..... 182/129, 182/230, 107, 214, 121; 248/210, 238, 235; 206/372, 373
See application file for complete search history.

(56) References Cited

U.S. PATENT DOCUMENTS

| | | | | |
|---|---|---|---|---|
| 4,205,862 | A | 6/1980 | Tarvin | 280/166 |
| 4,212,371 | A | 7/1980 | Gaviorno, Jr. | 182/121 |
| 4,261,435 | A | 4/1981 | Winter | 182/129 |
| 4,953,661 | A | 9/1990 | Hilton et al. | 182/120 |
| 5,342,008 | A * | 8/1994 | Kay | 248/238 |
| 5,584,357 | A | 12/1996 | Gugel et al. | 248/238 |
| 5,638,915 | A | 6/1997 | Hardy | 182/129 |
| 5,641,142 | A | 6/1997 | Hanson et al. | 248/238 |
| 5,740,883 | A * | 4/1998 | Trank | 182/129 |
| 5,913,380 | A | 6/1999 | Gugel et al. | 182/129 |
| 5,941,344 | A | 8/1999 | Spadaro | 182/129 |
| 6,116,163 | A | 9/2000 | Mitchell | 108/42 |
| 6,131,699 | A | 10/2000 | Leak, Jr. | 182/129 |
| 6,158,551 | A * | 12/2000 | Gray | 182/107 |
| 6,401,862 | B1 | 6/2002 | Caron | 182/129 |
| 6,412,601 | B1 | 7/2002 | Schmidt | 182/129 |
| 6,467,577 | B1 | 10/2002 | Charlebois, Jr. | 182/129 |
| 6,502,664 | B1 * | 1/2003 | Peaker, Sr. | 182/129 |
| 2002/0043429 | A1 | 4/2002 | Schmidt | 182/129 |
| 2002/0104709 | A1 | 8/2002 | Hines | 182/129 |
| 2002/0148684 | A1 | 10/2002 | Charlebois, Jr. | 182/129 |

FOREIGN PATENT DOCUMENTS

| | | |
|---|---|---|
| GB | 2093901 | 2/1981 |
| GB | 2093516 | 9/1981 |
| GB | 2114098 | 8/1983 |
| GB | 2277115 | 10/1994 |

* cited by examiner

*Primary Examiner*—Hugh B. Thompson, II

(57) ABSTRACT

A ladder attachment system for supporting a plurality of items in an easy to access location. The ladder attachment system includes a tray positionable upon an upper platform of a ladder, and a pair of extended legs extending from the tray for engaging the support legs of the ladder. The extended legs each include a pair of tab members for catchably receiving the support legs. The tray includes a plurality of threaded inserts for allowing the attachment of various accessories.

2 Claims, 13 Drawing Sheets

LADDER ATTACHMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to ladder attachments and more specifically it relates to a ladder attachment system for supporting a plurality of items in an easy to access location.

2. Description of the Related Art

Conventional ladders are typically comprised of a collapsible A-frame structure. A conventional ladder has two pairs of legs with steps attached between thereof. An upper platform pivotally supports the pairs of legs to allow for folding of the ladder into a compact storage structure. The upper platform sometimes will include a recessed portion and holes for receiving tools and materials. However, many ladders do not have a large enough upper platform or they do not have a structure capable of receiving and supporting a plurality of items.

While conventional ladders may be suitable for the particular purpose to which they address, they are not as suitable for supporting a plurality of items in an easy to access location. Conventional ladders do not have sufficient storage space for tools and materials required by a worker positioned upon the ladder.

In these respects, the ladder attachment system according to the present invention substantially departs from the conventional concepts and designs of the prior art, and in so doing provides an apparatus primarily developed for the purpose of supporting a plurality of items in an easy to access location.

BRIEF SUMMARY OF THE INVENTION

In view of the foregoing disadvantages inherent in the known types of ladders now present in the prior art, the present invention provides a new ladder attachment system construction wherein the same can be utilized for supporting a plurality of items in an easy to access location.

The general purpose of the present invention, which will be described subsequently in greater detail, is to provide a new ladder attachment system that has many of the advantages of the ladders mentioned heretofore and many novel features that result in a new ladder attachment system which is not anticipated, rendered obvious, suggested, or even implied by any of the prior art ladders, either alone or in any combination thereof.

To attain this, the present invention generally comprises a tray positionable upon an upper platform of a ladder, and a pair of extended legs extending from the tray for engaging the support legs of the ladder. The extended legs each include a pair of tab members for catchably receiving the support legs. The tray includes a plurality of threaded inserts for allowing the attachment of various accessories.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a ladder attachment system that will overcome the shortcomings of the prior art devices.

A second object is to provide a ladder attachment system for supporting a plurality of items in an easy to access location.

Another object is to provide a ladder attachment system that is attachable to various types and sizes of ladders.

An additional object is to provide a ladder attachment system that is capable of supporting a plurality items including tools, fasteners and work materials.

A further object is to provide a ladder attachment system that safely supports a plurality of items used by a worker on a ladder.

Another object is to provide a ladder attachment system that reduces the number of trips a person has to make up and down a ladder to retrieve additional tools.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
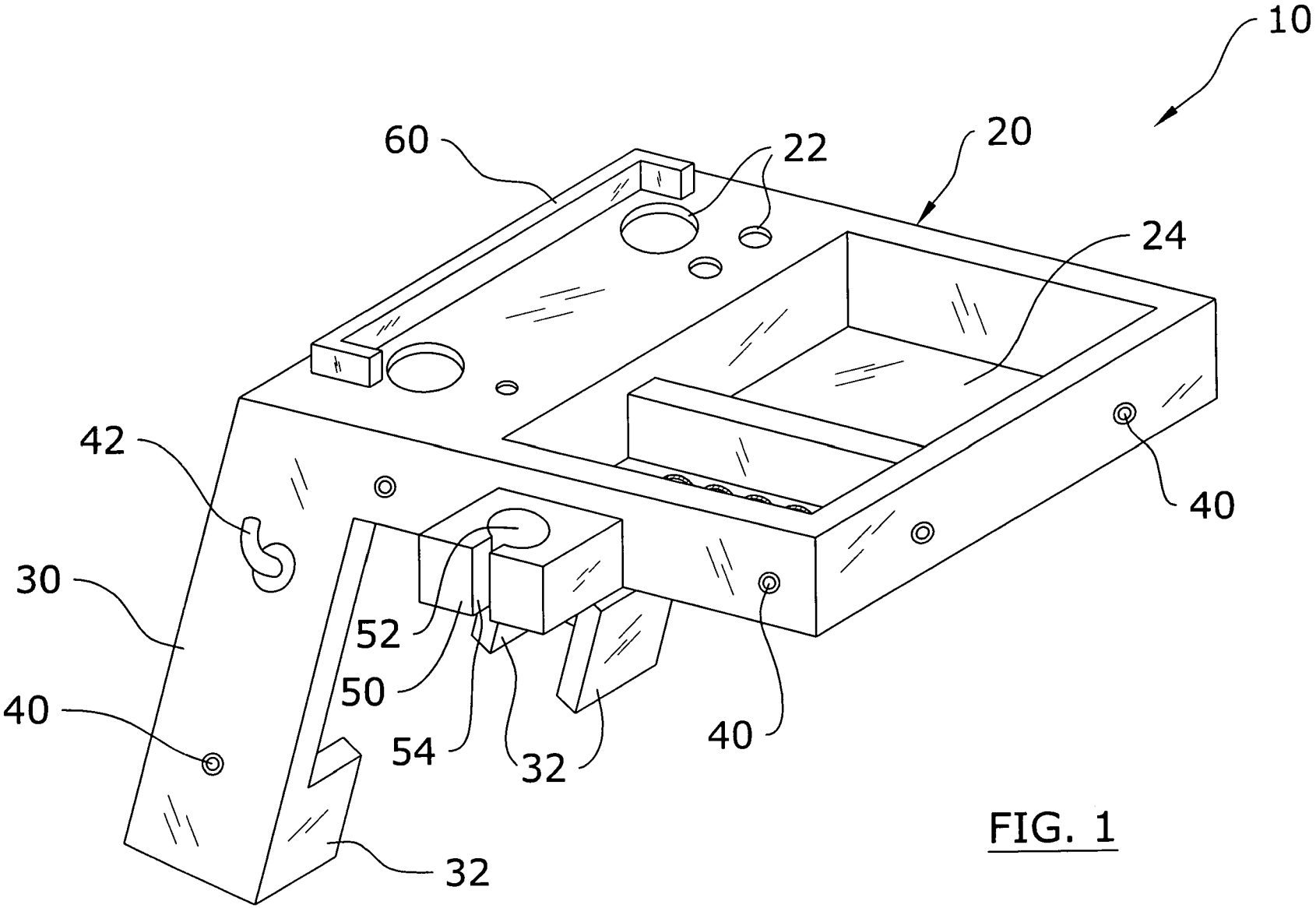
FIG. 1 is an upper perspective view of the present invention.

Turning now descriptively to the drawings, in which similar reference characters denote similar elements throughout the several views, FIGS. 1 through 13 illustrate a ladder attachment system 10, which comprises a tray 20 positionable upon an upper platform 14 of a ladder 12, and a pair of extended legs 30 extending from the tray 20 for engaging the support legs 16 of the ladder 12. The extended legs 30 each include a pair of tab members 32 for catchably receiving the support legs 16. The tray includes a plurality of threaded inserts 40 for allowing the attachment of various accessories.

B. Tray

Figure 4:
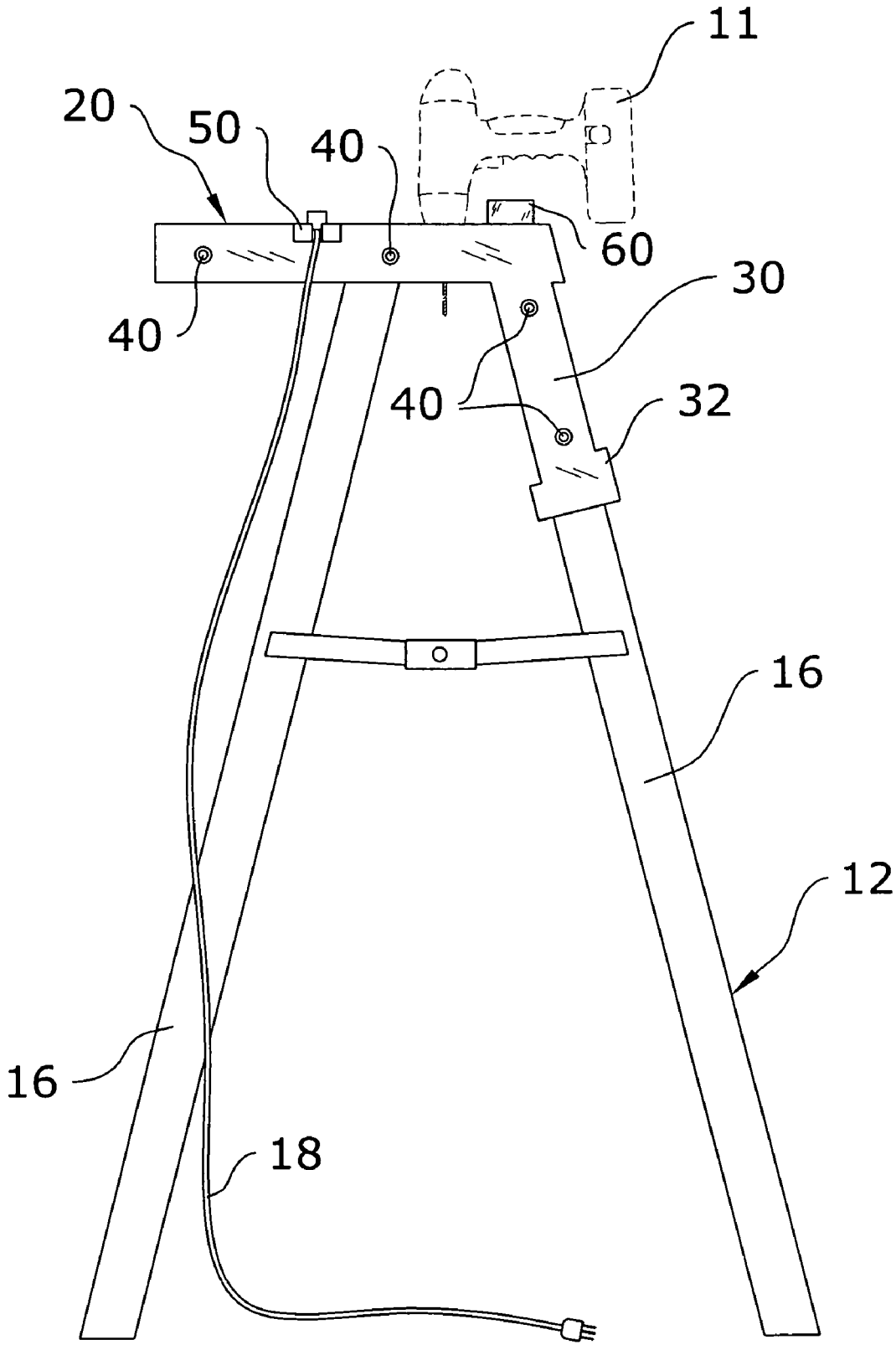
FIG. 4 is a side view of the present invention attached to a ladder.
Figure 5:
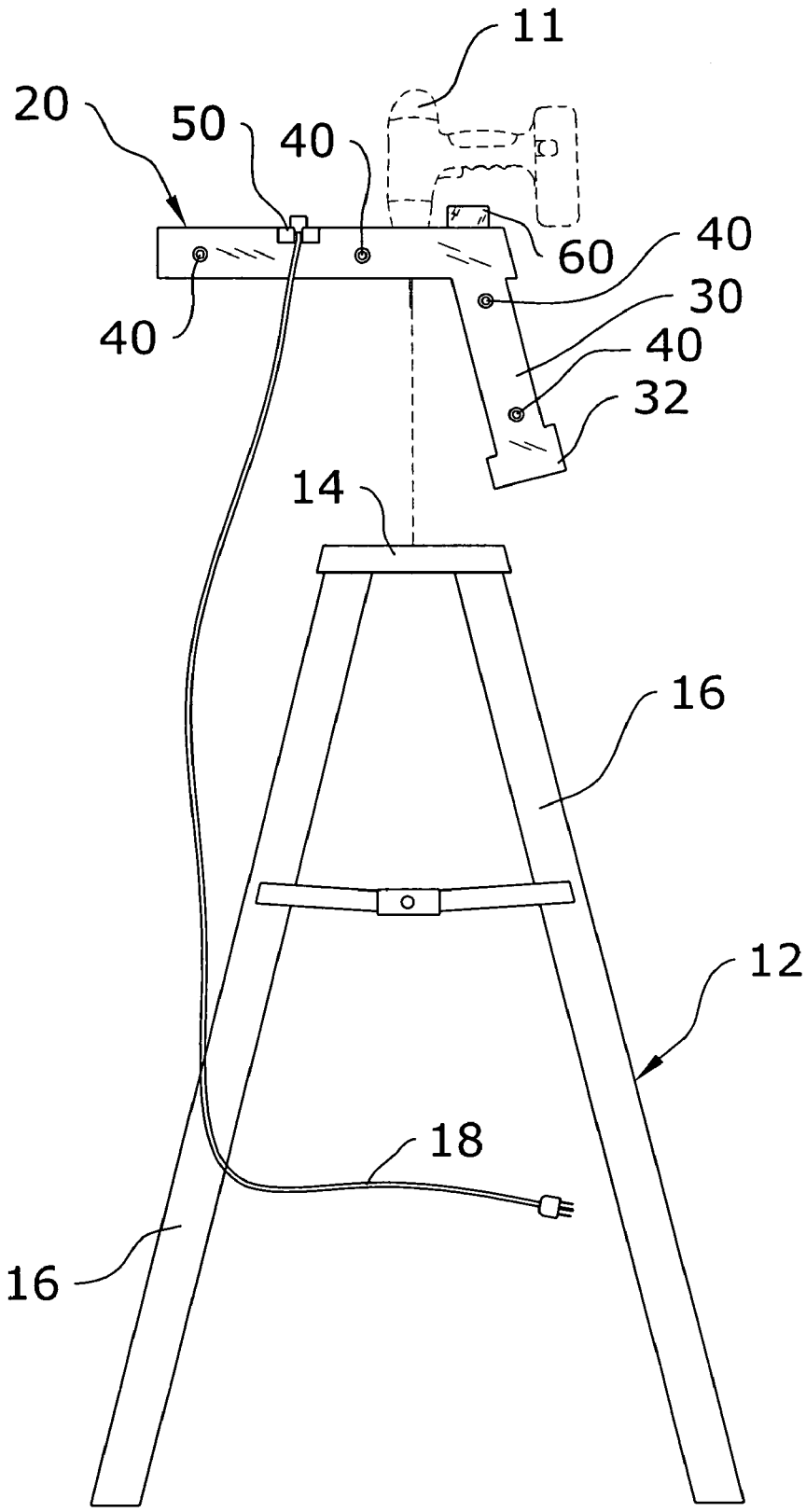
FIG. 5 is a side view of the present invention positioned above a ladder.
Figure 8:
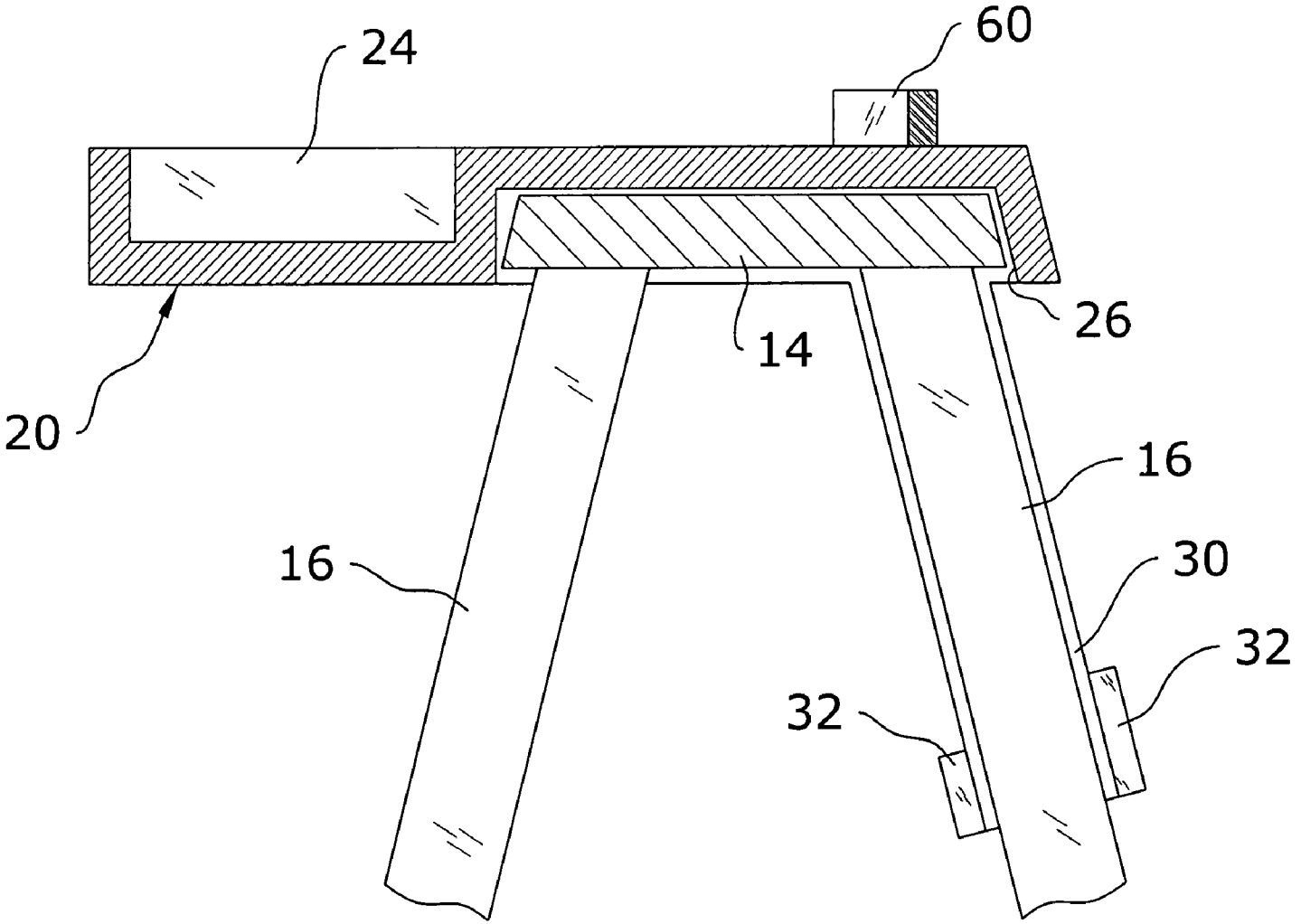
FIG. 8 is a cross sectional view taken along line 8—8 of FIG. 6.

The tray 20 is preferably positionable upon an upper platform 14 of a ladder 12 as shown in FIGS. 4 and 5 of the drawings. The tray 20 preferably includes a lower cavity 26 that receives an upper platform 14 of a ladder 12 as shown in FIG. 8 of the drawings. The lower cavity 26 is formed to receive various sizes and shapes of upper platforms 14 that are commonly utilized on ladders 12. The tray 20 may be comprised of various materials such as but not limited to plastic, composite and wood.

Figure 2:
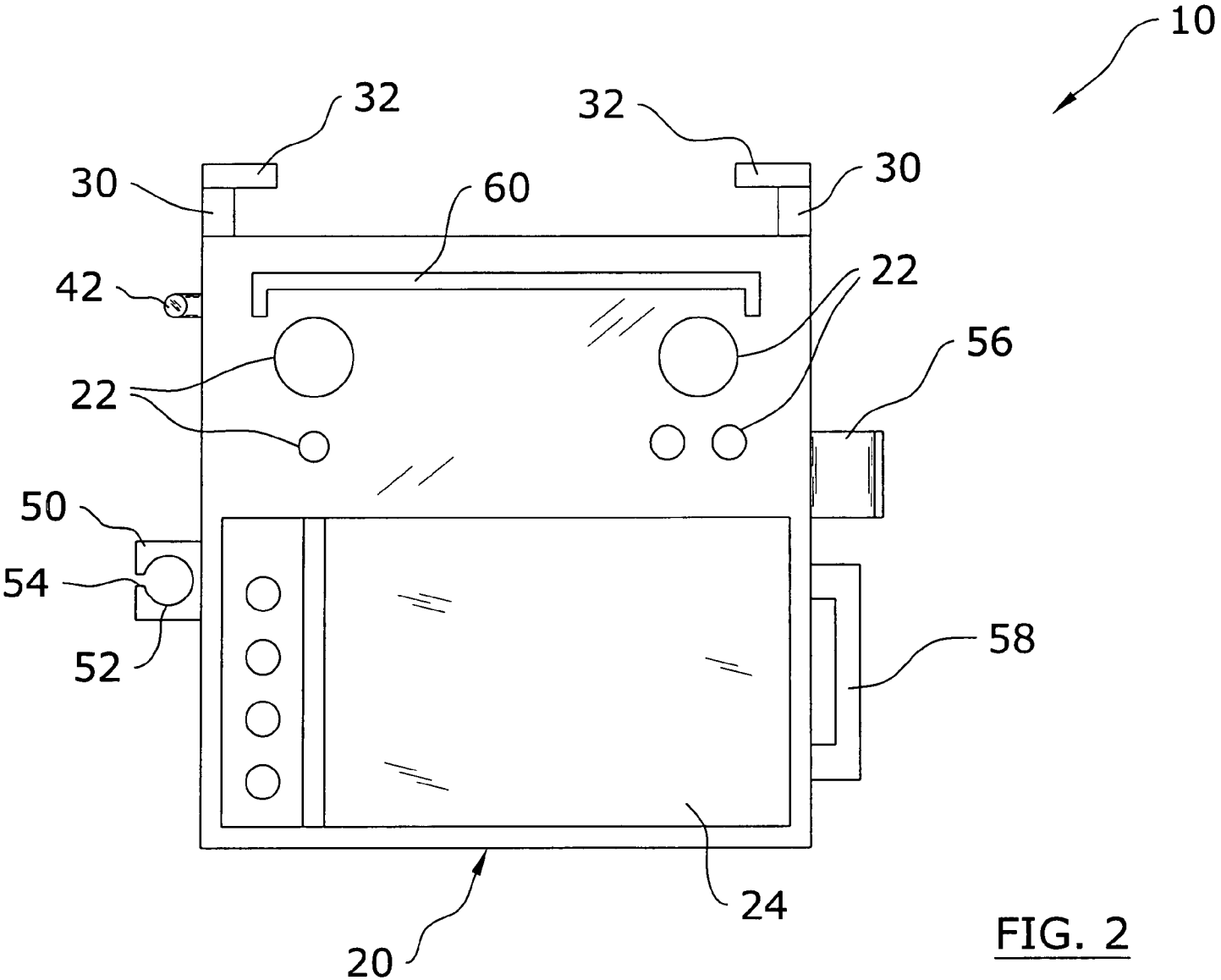
FIG. 2 is a top view of the present invention.

An upper cavity 24 preferably extends into an upper and forward portion of the tray 20 as best illustrated in FIGS. 1 and 2 of the drawings. The upper cavity 24 is preferably positioned opposite within the tray 20 of the lower cavity 26 as best shown in FIG. 8 of the drawings. The upper cavity 24 is formed for receiving various items including tools and work materials. The upper cavity 24 is surrounded by an outer perimeter to prevent the items from falling from the tray 20. The upper cavity 24 may have various shapes and sizes as can be appreciated by one skilled in the art. In addition, one or more partitions may be positioned within the upper cavity 24 for providing separate individual cavities within the upper cavity 24.

Figure 3:
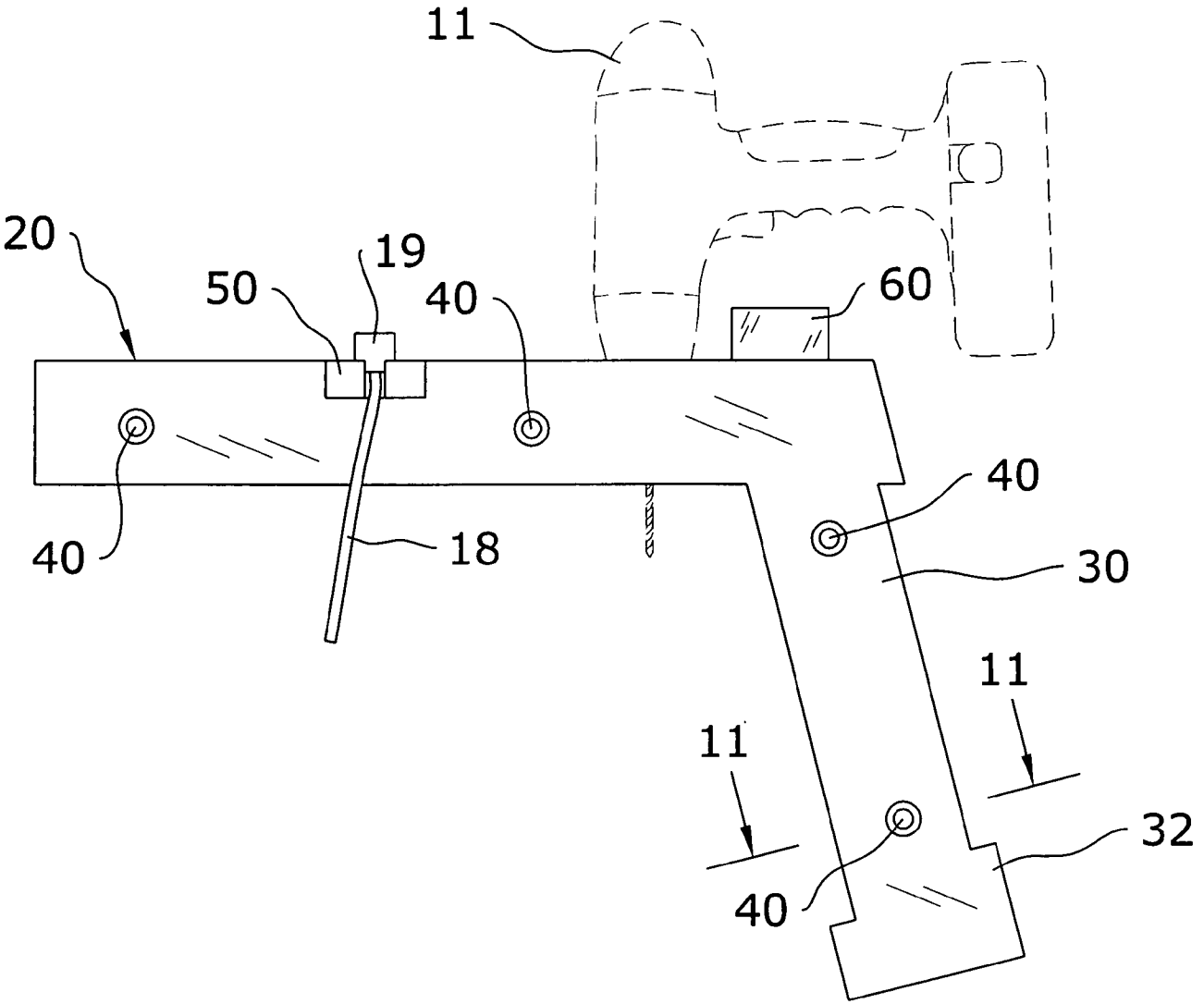
FIG. 3 is a side view of the present invention.

A first side bracket 50 preferably extends from a side of the tray 20 as best shown in FIG. 1 of the drawings. A bracket opening 52 extends vertically through the first side bracket 50 as best shown in FIG. 2 of the drawings. The bracket opening 52 is formed for receiving a receptacle end 19 of a power cord 18 as illustrated in FIG. 3 of the drawings. A side slot 54 extends into the side of the first side bracket 50 and is connected to the bracket opening 52 for receiving a cord portion of a power cord 18 as shown in FIGS. 1 through 3 of the drawings. The user is able to extend the cord portion of the power cord 18 through the side slot 54 with the receptacle end 19 positioned above the first side bracket 50 and then lower the receptacle end 19 into the bracket opening 52 to be securely retained. With the receptacle end 19 of the power cord 18 positioned within the bracket opening 52 of the first side bracket 50, the user is able to easily electrically connect various hand tools such as but not limited to drills 11 and saws to the receptacle end 19 without having to physically retain the receptacle end 19. In addition, the receptacle end 19 is positioned in a convenient and secure location when the user is positioned upon the ladder 12 working.

A second side bracket 56 extends from the tray 20 opposite of the first side bracket 50 as best shown in FIG. 2 of the drawings. The second side bracket 56 preferably has a hook structure or related structure capable of receiving various types of items. As shown in FIG. 2 of the drawings, a loop member 58 preferably extends from a side of the tray 20 where additional tools and items may be secured to.

As shown in FIGS. 1 and 2 of the drawings, at least one receiver aperture 22 extends within the tray 20 for receiving an item such as but not limited to tools (e.g. drills 11, screwdrivers, wrenches, pliers, etc.) and materials. The receiver apertures 22 may have various and varying shapes/sizes in order to accommodate various items as further shown in FIG. 2 of the drawings. The receiver apertures 22 are preferably aligned with preexisting openings within the upper platform 14 of the ladder 12 to allow for the items to pass through the tray 20 and the upper platform 14. As shown in FIGS. 1 and 2, the receiver apertures 22 are preferably positioned within the rear portion of the tray 20 and extend into the lower cavity 26.

A painting pan bracket 60 preferably extends upwardly from an upper surface of the tray 20 as best illustrated in FIGS. 1 and 2 of the drawings. The painting pan bracket 60 preferably has a U-shaped structure for preventing a painting pan from accidentally moving upon the upper surface of the tray 20.

A plurality of threaded inserts 40 are preferably positioned within the tray 20 that have interior threading. The threaded inserts 40 may be comprised of metal inserts or apertures within the tray 20 that are interiorly threaded. The threaded inserts are preferably positioned within the side portions of the tray 20 and the extended legs 30; however the threaded inserts 40 may be positioned within the upper portion and lower portion of the tray 20.

At least one accessory 42 with a threaded portion is provided for being threadably attached within one of the threaded inserts 40. The at least one accessory 42 may comprised of a hook structure or other retaining structure. The user is able to reposition the accessory 42 in various locations upon the tray 20 and the extended legs 30 as desired for supporting various types of items.

Figure 12:
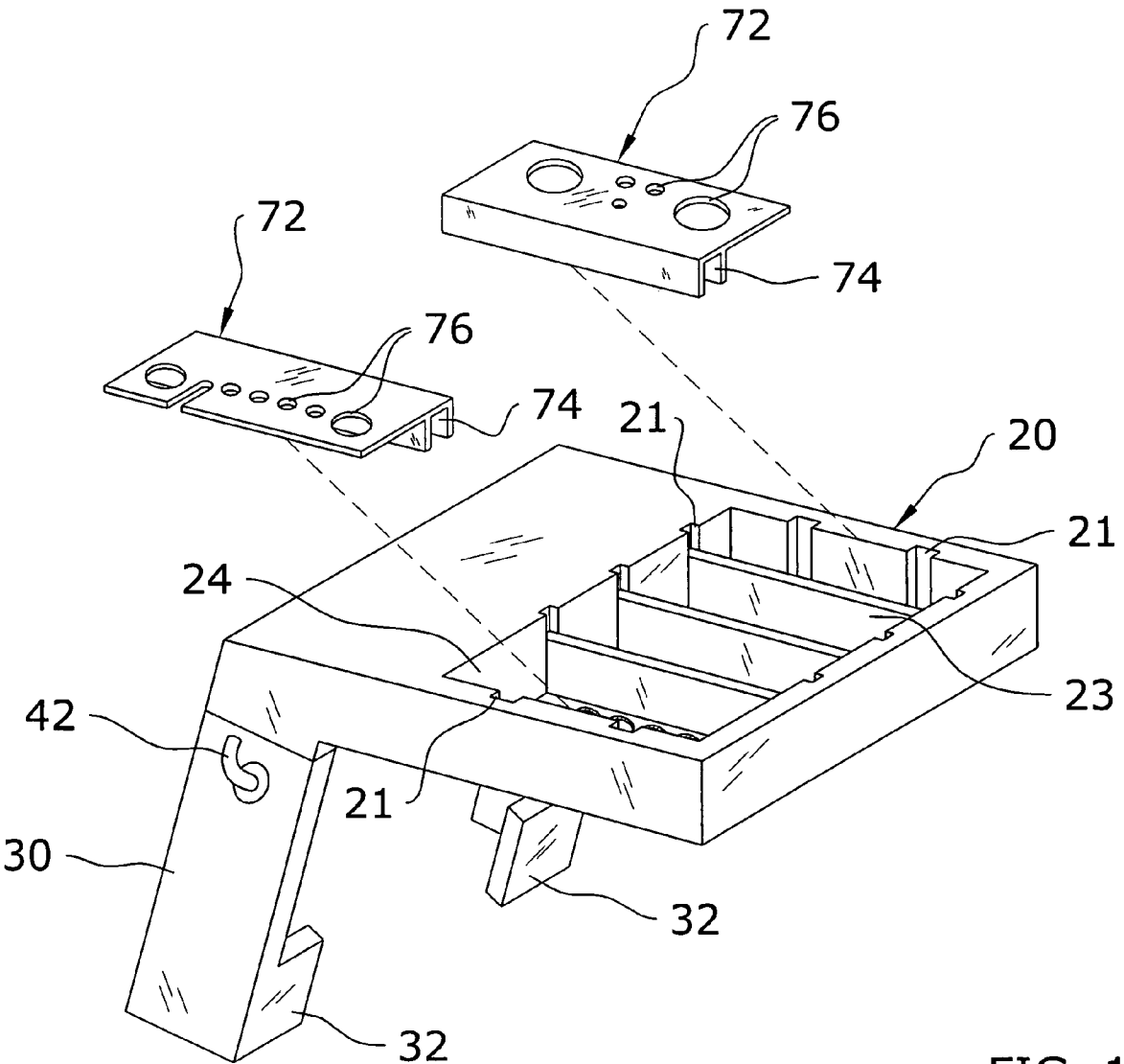
FIG. 12 is an exploded upper perspective view of an alternative variation showing accessory wings and dividers.
Figure 13:
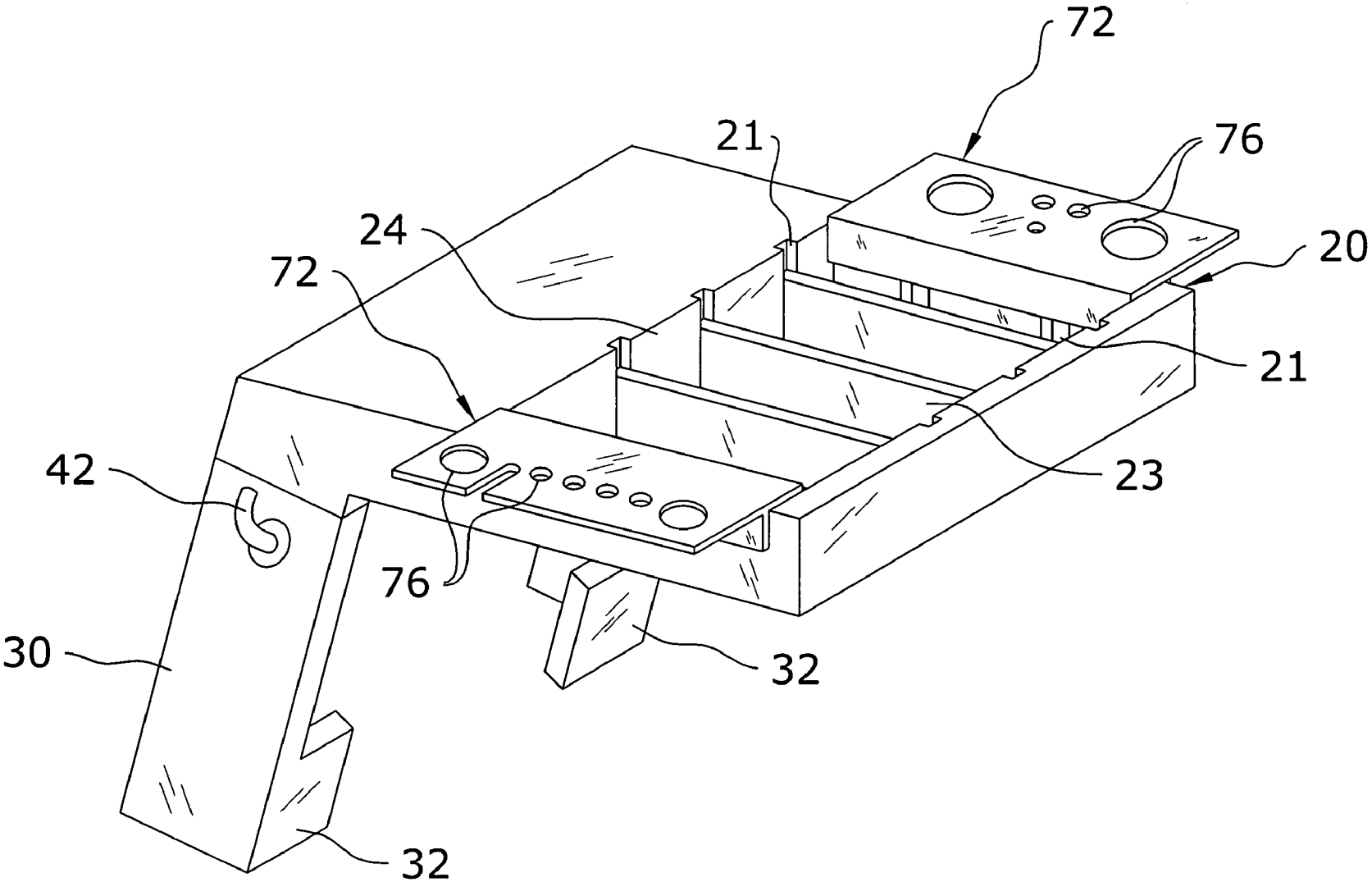
FIG. 13 is an upper perspective view of the alternative variation showing accessory wings and dividers.

FIGS. 12 and 13 illustrate a plurality of divider slots 21 extending into the interior sidewalls of the tray 20 for receiving one or more dividers 23. The divider slots 21 preferably extend into both the fore/aft and side sidewalls of the upper cavity 24 of the tray 20. The user is able to removably insert one or more dividers 23 to create various compartment sizes and configurations.

C. Extended Legs

The pair of extended legs 30 extend from the tray 20 for engaging a corresponding pair of support legs 16 of the ladder 12 as shown in FIGS. 1 through 7 of the drawings. The extended legs 30 preferably extend at an angle from the tray 20 that corresponds to an angle of a pair of support legs 16 of a ladder 12 (i.e. the angle the support legs 16 have with respect to the upper platform 14) as best shown in FIGS. 4 and 5 of the drawings. The extended legs 30 may have various lengths, however it is desirable that the legs have at least a 6 inch length to provide a desired amount of leverage to offset the weight of items positioned upon the front portion of the tray 20.

Figure 7:
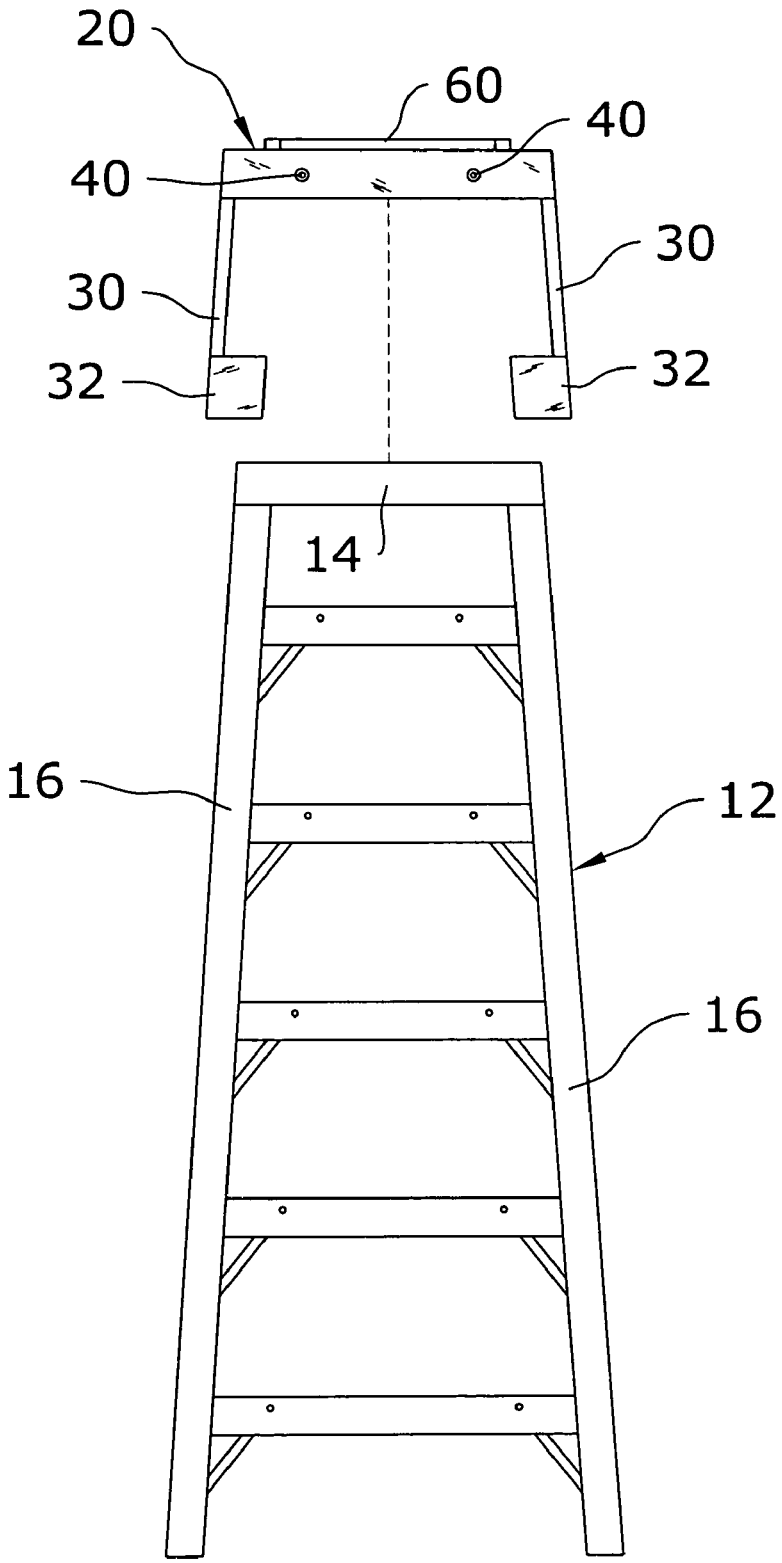
FIG. 7 is a rear view of the present invention positioned above a ladder.
Figure 11:
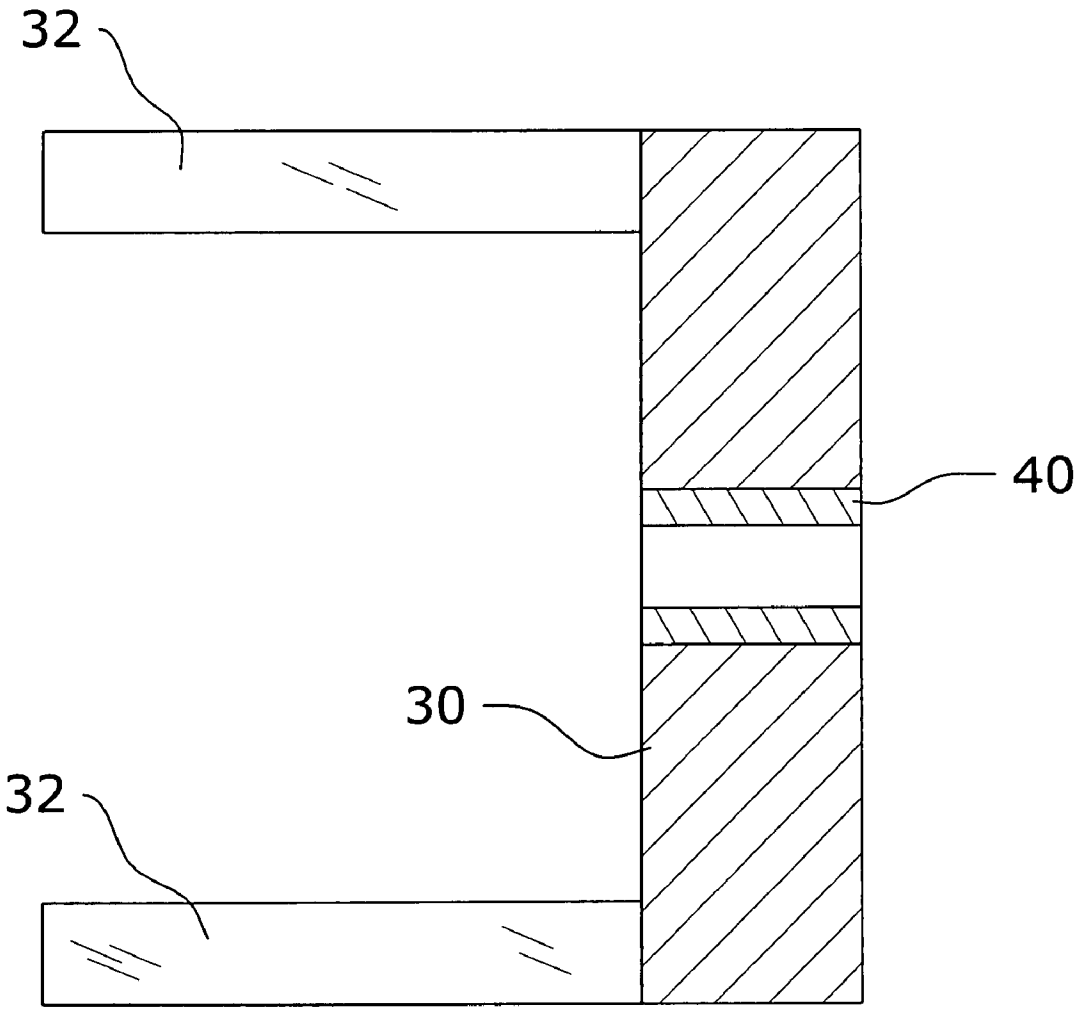
FIG. 11 is a cross sectional view taken along line 11—11 of FIG. 3.

The extended legs 30 each preferably include a pair of tab members 32 forming a U-shaped structure for catchably receiving a pair of support legs 16 of a ladder 12 as shown in FIGS. 7 and 11 of the drawings. The tab members 32 preferably extend transversely from the interior side of each of the extended legs 30 and are formed to catchably engage the support legs 16 of the ladder 12.

Figure 9:
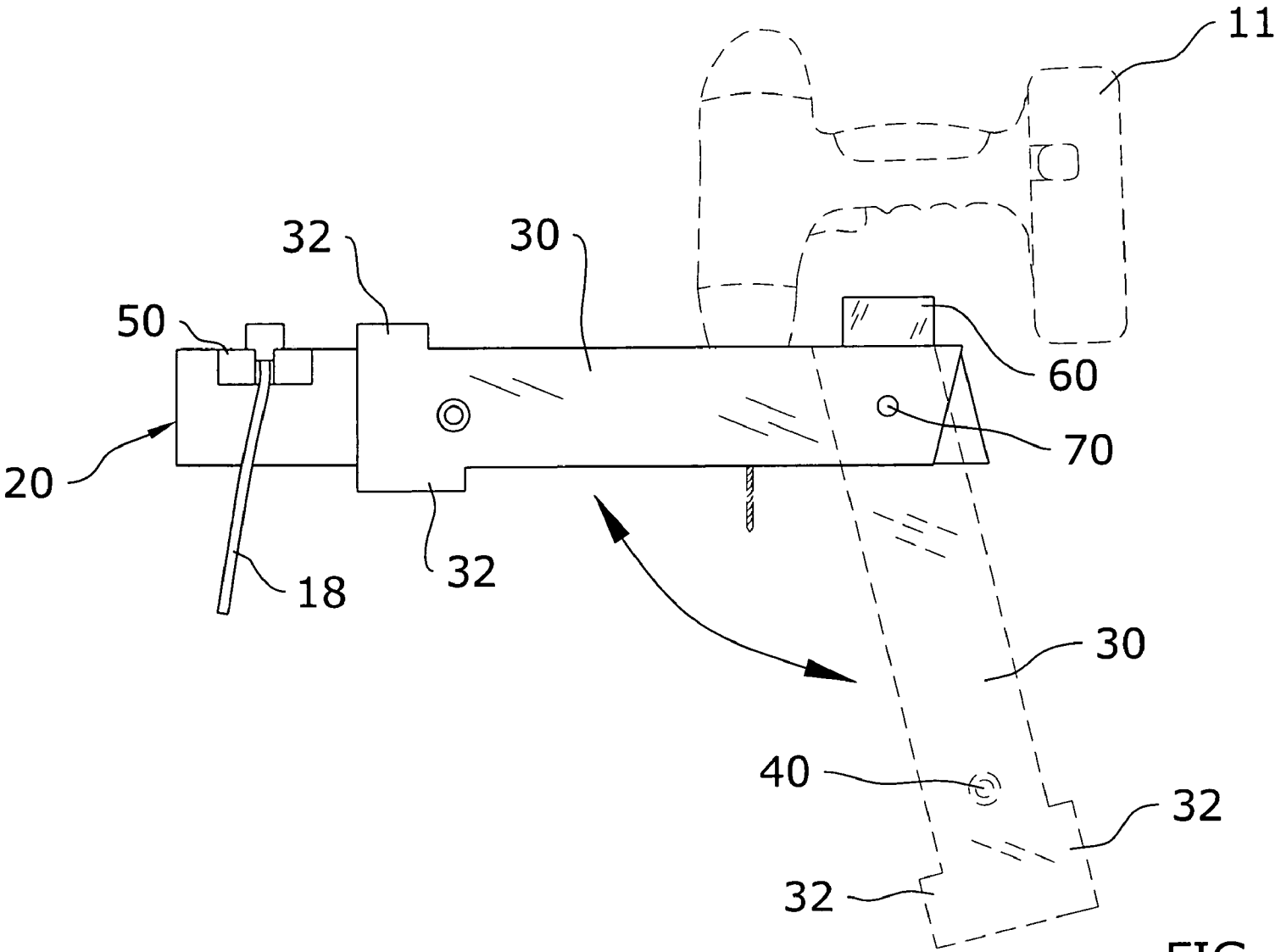
FIG. 9 is a side view of an alternative embodiment of the present invention illustrating the extended legs pivotally attached to the tray in a forward manner.
Figure 10:
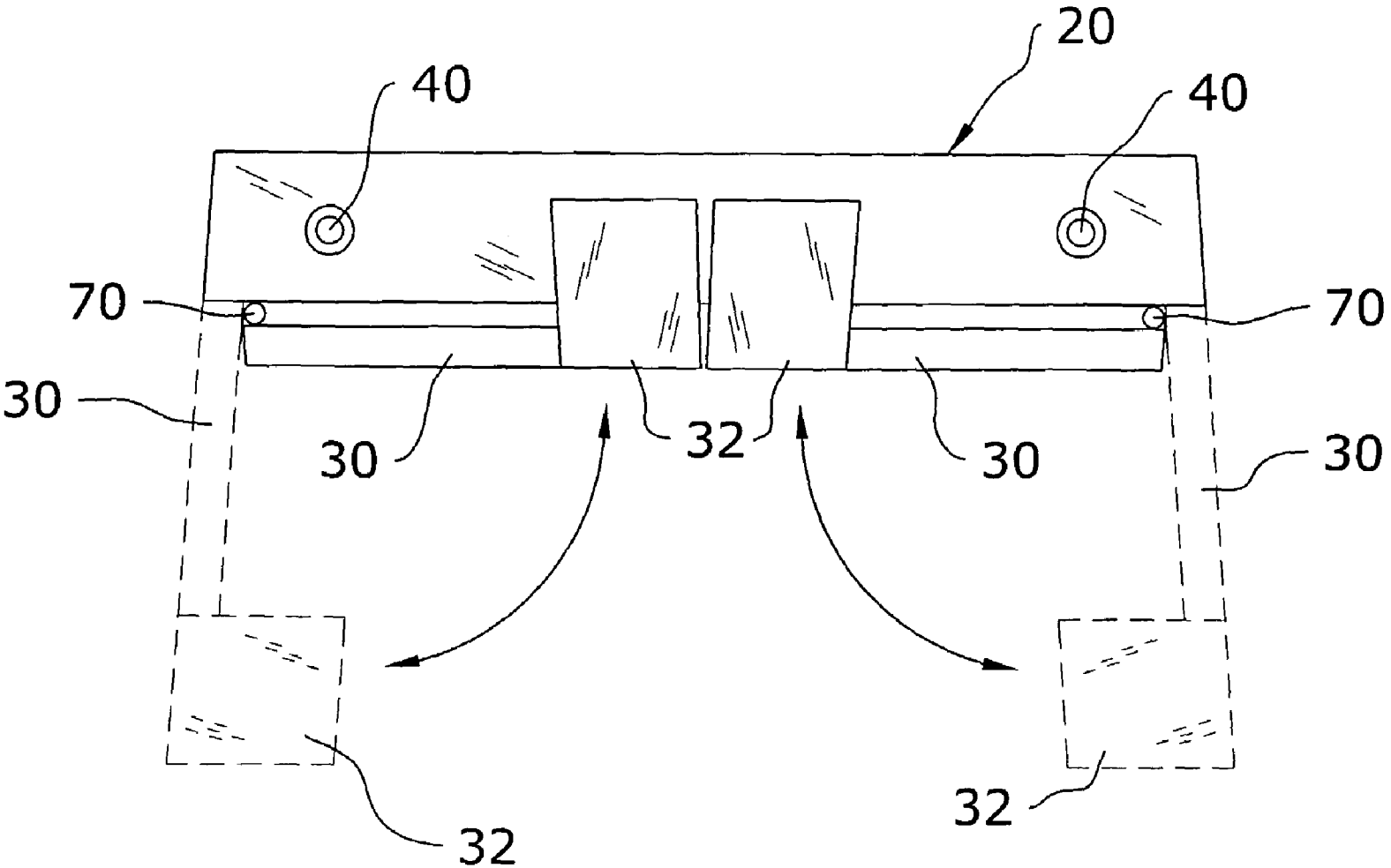
FIG. 10 is a rear view of a second alternative embodiment of the present invention illustrating the extended legs pivotally attached to the tray in an inward manner.

The extended legs 30 may also be pivotally attached to the tray 20 for folding forwardly or inwardly toward one another as shown in FIGS. 9 and 10 of the drawings. FIG. 9 shows the extended legs 30 pivotally attached to the tray 20 at a hinge 70 with a forward pivoting capability wherein the extended legs 30 may be folded along the sides of the tray 20 for storage when not in use. FIG. 10 shows the extended legs 30 pivotally attached to the tray 20 at a hinge 70 with an inwardly pivoting capability wherein the extended legs 30 may be folded inwardly beneath the tray 20 for storage when not in use.

D. Accessory Wings

FIG. 12 illustrates an alternative variation where one or more accessory wings 72 are attachable to the sides of the tray 20. The accessory wings 72 have a receiver slot 74 that receives a sidewall of the tray 20 as further shown in FIGS. 12 and 13 of the drawings.

The receiver slot 74 within the accessory wing 72 may be formed by a pair of opposing extended members or other structure. The receiver slot 74 is preferably formed to snugly fit about the sidewalls of the tray as shown in FIG. 13 of the drawings. The accessory wings 72 preferably have an L-shaped structure with one or more accessory apertures 76 extending into the accessory wing 72 for receiving one or more objects (e.g. tools).

E. Operation of Invention

Figure 6:
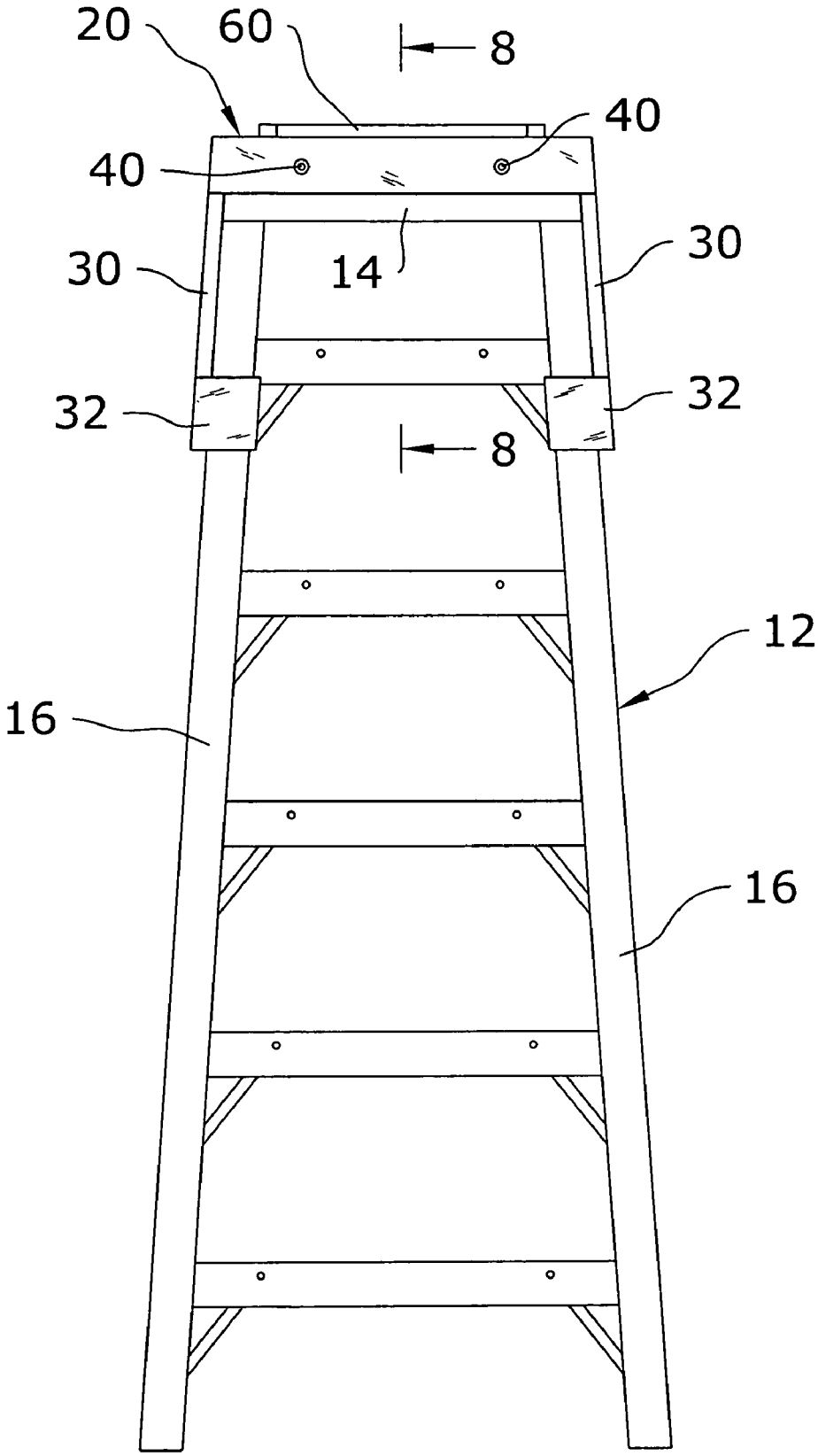
FIG. 6 is a rear view of the present invention attached to a ladder.

To use the invention, the user first positions the invention above the upper platform 14 of the ladder 12 as shown in FIGS. 5 and 7 of the drawings. The user then lowers the tray 20 downwardly upon the upper platform 14 so that the lower cavity 26 receives the upper platform 14 of the ladder 12 as shown in FIGS. 4, 6 and 8 of the drawings. As the tray 20 is lowered, the extended legs 30 and the respective tab members 32 extend along the outer sides of the support legs 16 of the ladder 12 with the tab members 32 positioned about the front portion and the rear portion of the support legs 16 in a retaining manner. When the tray 20 is fully positioned, the tab members 32 prevent pivoting of the tray 20 or the extended legs 30 thereby providing stability to the tray 20 regardless of the items positioned upon the tray 20. The lower cavity 26 prevents forward/rearward movement of the tray 20 on the upper platform 14 also. The user is then able to position their required items such as but not limited to tools and work materials upon the tray 20 as discussed previously. When finished, the user simply elevates the tray 20 from the ladder 12 and then places the invention in storage.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A ladder attachment system, comprising:

a tray positionable upon an upper platform of a ladder, wherein said tray includes a lower cavity having opposed sloped, and perpendicular edges that are adapted to matingly receive an upper platform of a ladder and an upper cavity, and wherein said upper cavity is positioned opposite within said tray of said lower cavity;

a first side bracket extending from said tray including a bracket opening for receiving an end of a power cord and a side slot for receiving a cord portion of a power cord, wherein said bracket opening is formed for receiving a receptacle end of a power cord;

a second side bracket extending from said tray opposite of said first side bracket, wherein said second side bracket has a hook structure;

a loop member extending from a side of said tray;

at least one receiver aperture extending within said tray for receiving an item;

a painting pan bracket extending upwardly from an upper surface of said tray, wherein said painting pan bracket has a U-shaped structure;

a plurality of threaded inserts positioned within said tray;

at least one accessory with a threaded portion for being threadably attached within one of said threaded inserts, wherein said at least one accessory is comprised of a hook structure; and a pair of extended legs extending from the tray for engaging a corresponding pair of support legs of a ladder, wherein said extended legs each include a pair of tab members forming a U-shaped structure for catchably receiving a pair of support legs of a ladder, wherein said extended legs extend at an angle from said tray that corresponds to an angle of a pair of support legs of a ladder and wherein said extended legs are pivotally attached to said tray for folding forwardly or inwardly toward one another.

2. The ladder attachment system of claim 1, wherein said tray includes a plurality of divider slots extending into sidewalls of the upper cavity within said tray and at least one divider removably positionable within said divider slots.

* * * * *